US008816256B2

(12) United States Patent
Ohtani et al.

(10) Patent No.: US 8,816,256 B2
(45) Date of Patent: Aug. 26, 2014

(54) HEAT GENERATING BODY

(75) Inventors: Sumio Ohtani, Minami-ashigara (JP); Tadashi Kuriki, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 337 days.

(21) Appl. No.: 12/937,116

(22) PCT Filed: Apr. 10, 2009

(86) PCT No.: PCT/JP2009/057401

§ 371 (c)(1),
(2), (4) Date: Oct. 8, 2010

(87) PCT Pub. No.: WO2009/125855

PCT Pub. Date: Oct. 15, 2009

(65) Prior Publication Data

US 2011/0049129 A1 Mar. 3, 2011

(30) Foreign Application Priority Data

Apr. 11, 2008 (JP) ..... 2008-103632

(51) Int. Cl.
*H05B 3/03* (2006.01)
*F21S 8/10* (2006.01)
*H05B 3/84* (2006.01)

(52) U.S. Cl.
CPC . *H05B 3/84* (2013.01); *F21S 48/34* (2013.01); *H05B 2203/017* (2013.01); *H05B 2203/011* (2013.01)
USPC ..... 219/538

(58) Field of Classification Search
USPC ..... 219/203, 522, 538, 543, 548, 549, 552, 219/553
See application file for complete search history.

(56) References Cited

U.S. PATENT DOCUMENTS

| | | | | | |
|---|---|---|---|---|---|
| 3,152,313 | A | * | 10/1964 | Barbour et al. | 338/214 |
| 3,947,837 | A | | 3/1976 | Bitterice | |
| 4,772,760 | A | | 9/1988 | Graham | |
| 4,803,324 | A | * | 2/1989 | Fujii et al. | 219/759 |
| 4,971,848 | A | * | 11/1990 | Ruelle et al. | 428/38 |
| 5,796,071 | A | | 8/1998 | Morin et al. | |
| 6,011,270 | A | * | 1/2000 | Izumi | 250/504 R |

(Continued)

FOREIGN PATENT DOCUMENTS

| | | |
|---|---|---|
| EP | 0364247 | 4/1990 |
| EP | 0728711 | 8/1996 |

(Continued)

OTHER PUBLICATIONS

International Search Report, PCT/JP2009/057401, Jul. 14, 2009.

(Continued)

*Primary Examiner* — Tu B Hoang
*Assistant Examiner* — Brandon Harvey
(74) *Attorney, Agent, or Firm* — Young & Thompson

(57) ABSTRACT

A heat generating body has a first electrode and a second electrode arranged opposed to each other, and also has a mesh-like electrically conductive membrane (mesh-like pattern) mounted in a curved surface shape between the first electrode and the second electrode. The first electrode and the second electrode are arranged so as to satisfy the relationship of (Lmax−Lmin)/((Lmax+Lmin)/2)=0.375, where Lmin is a minimum value of the distance between two opposite points which are on the first and second electrodes and on the electrically conductive membrane and Lmax is a maximum value of the distance.

7 Claims, 23 Drawing Sheets

(56) References Cited

U.S. PATENT DOCUMENTS

| | | | | |
|---|---|---|---|---|
| 6,211,491 | B1 * | 4/2001 | Mazaki | 219/203 |
| 6,937,380 | B2 | 8/2005 | Fanton et al. | |
| 7,626,128 | B2 | 12/2009 | Takada | |
| 2001/0001973 | A1 * | 5/2001 | Ito et al. | 156/106 |
| 2006/0011596 | A1 * | 1/2006 | Sharp et al. | 219/203 |
| 2010/0200286 | A1 | 8/2010 | Melcher et al. | |

FOREIGN PATENT DOCUMENTS

| | | |
|---|---|---|
| JP | 05-205859 | 8/1993 |
| JP | 10-289602 | 10/1998 |
| JP | 2007-026989 | 2/2007 |
| WO | 02/071138 | 9/2002 |
| WO | 2006/040989 | 4/2006 |
| WO | WO 2007031710 A2 * | 3/2007 |
| WO | 2008/020141 | 2/2008 |

OTHER PUBLICATIONS

Canadian Official Action—2,720,899—Feb. 20, 2013.
Japanese Official Action—2009-096197—Apr. 2, 2013.
Extended European Search Report dated Oct. 11, 2013; Application No. 09729555.4.
Japanese Official Action dated Dec. 10, 2013 issued over the corresponding Japanese Patent Application No. 2009-096197; with partial English translation.

* cited by examiner

HEAT GENERATING BODY

TECHNICAL FIELD

The present invention relates to a transparent heat generator excellent in visibility and heat generation, particularly to a heat generator useful in an electric heating structure for car light front covers and various applications.

BACKGROUND ART

In general, illuminance of a car light may be reduced due to the following causes:

(1) adhesion and accumulation of snow on the outer circumferential surface of the front cover, (2) adhesion and freezing of rain water or car wash water on the outer circumferential surface of the front cover, and (3) progression of (1) and (2) due to use of an HID lamp light source having a high light intensity even under a low power consumption (a small heat generation amount).

Structures described in Japanese Laid-Open Patent Publication Nos. 2007-026989 and 10-289602 have been proposed in view of preventing the above illuminance reduction of the car light.

The structure described in Japanese Laid-Open Patent Publication No. 2007-026989 is obtained by printing a conductive pattern on a transparent insulating sheet to prepare a heat generator, and by attaching the heat generator to a formed lens using an in-mold method. Specifically, the conductive pattern in the heat generator is composed of a composition containing a noble metal powder and a solvent-soluble thermoplastic resin.

The structure described in Japanese Laid-Open Patent Publication No. 10-289602 is obtained by attaching a heat generator into a lens portion of a car lamp. The lens portion is heated by applying an electric power to the heat generator under a predetermined condition. The document describes that the heat generator comprises a transparent conductive film of ITO (Indium Tin Oxide), etc.

DISCLOSURE OF THE INVENTION

However, in the heat generator described in Japanese Laid-Open Patent Publication No. 2007-026989, the conductive pattern has a large width of 50 to 500 μm. Particularly, a printed conductive wire having a width of 0.3 mm is used in the conductive pattern in Examples of Japanese Laid-Open Patent Publication No. 2007-026989. Such a thick conductive wire is visible to the naked eye, and the heat generator is disadvantageous in transparency.

For example, in the case of using the thick conductive wire on a front cover of a headlamp, one wire is arranged in a zigzag manner, so that a long conductive line is formed to obtain a desired resistance value (e.g. about 40 ohm). However, a potential difference is disadvantageously generated between adjacent conductive lines, causing migration.

On the other hand, the heat generator described in Japanese Laid-Open Patent Publication No. 10-289602 comprises the transparent conductive film of ITO or the like. The film cannot be formed on a curved surface of a formed body by a method other than vacuum sputtering methods. Thus, the heat generator is disadvantageous in efficiency, cost, etc.

In addition, since the transparent conductive film is composed of a ceramic such as ITO, the film is often cracked when a sheet on which the transparent conductive film is formed is bent in an in-mold method. Therefore, it is difficult to use the film in a curved-surface body having a transparent heater, such as a car light front cover.

In view of the above problems, an object of the present invention is to provide such a heat generator capable of having a substantially transparent surface heat generation film on a curved surface, having an improved heat generation uniformity, preventing the migration, and having a transparent heater formed on a curved-surface body inexpensively.

The above object of the present invention is achieved by the following heat generator.

[1] A heat generator according to the present invention, comprising first and second electrodes arranged facing each other and a mesh conductive film arranged in a curved surface shape between the first and second electrodes, wherein when two opposite points in the first and second electrodes are at a distance on the conductive film, Lmin is a minimum value of the distance, and Lmax is a maximum value of the distance, the first and second electrodes satisfy the inequality:

$$(L\max-L\min)/((L\max+L\min)/2)\leq 0.375.$$

[2] A heat generator according to [1], wherein the mesh conductive film has a mesh pattern containing a conductive thin metal wire with a plurality of lattice intersections, and the thin metal wire in the mesh pattern has a width of 1 to 40 μm.

[3] A heat generator according to [1] or [2], wherein the mesh conductive film has a mesh pattern containing a conductive thin metal wire with a plurality of lattice intersections, and the thin metal wire in the mesh pattern has a pitch of 0.1 to 50 mm.

[4] A heat generator according to any one of [1] to [3], wherein the mesh conductive film has a mesh pattern containing a conductive thin metal wire with a plurality of lattice intersections, and the thin metal wire in the mesh pattern contains a metallic silver portion formed by exposing and developing a silver salt-containing layer containing a silver halide.

[5] A heat generator according to any one of [1] to [3], wherein the mesh conductive film has a mesh pattern containing a conductive thin metal wire with a plurality of lattice intersections, and the thin metal wire in the mesh pattern contains a patterned, plated metal layer.

[6] A heat generator according to any one of [1] to [5], wherein the heat generator has a surface resistance of 10 to 500 ohm/sq.

[7] A heat generator according to any one of [1] to [6], wherein the heat generator has an electrical resistance of 12 to 120 ohm.

[8] A heat generator according to any one of [1] to [7], wherein the heat generator has a three-dimensional curved surface with a minimum curvature radius of 300 mm or less.

As described above, in the heat generator of the present invention, a substantially transparent surface heat generation film can be formed on a curved surface, the heat generation uniformity can be improved, the migration can be prevented, and a transparent heater can be inexpensively formed on a curved-surface body.

BEST MODE FOR CARRYING OUT THE INVENTION

An embodiment of the heat generator of the present invention will be described below with reference to FIGS. 1 to 23.

Figure 1:
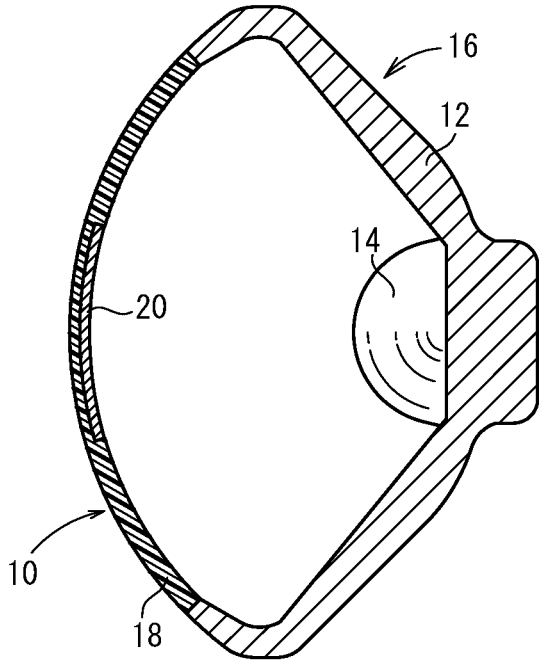
FIG. 1 is a cross-sectional view partially showing a front cover using a heat generator according to an embodiment of the present invention.

As shown in FIG. 1 omitted in part, a car light front cover 10 (hereinafter referred to as the front cover 10) has a heat generator 20 according to the embodiment (hereinafter referred to also as the transparent heat generator 20) and a cover body 18 composed of a polycarbonate resin, etc. The front cover 10 is attached to a front opening of a car light 16 having a lamp body 12 and a light source 14 disposed therein.

The heat generator 20 has a curved surface shape, and is disposed in a part of a surface facing the light source 14 on the cover body 18 of the front cover 10.

Figure 2:
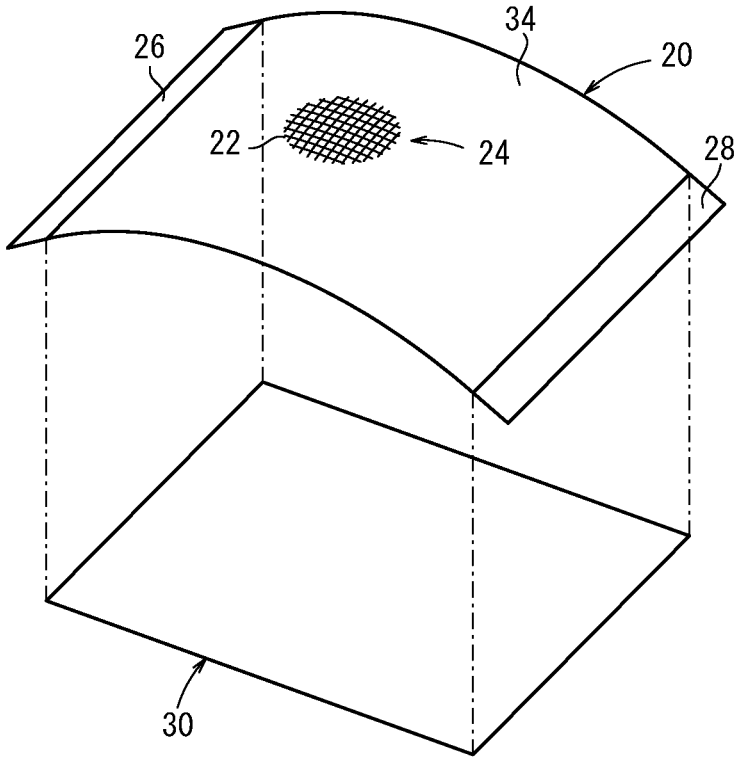
FIG. 2 is a perspective view showing the heat generator of the embodiment.

As shown in FIG. 2, the heat generator 20 contains a first electrode 26 and a second electrode 28 arranged facing each other, and further contains a mesh conductive film 24 arranged in a curved surface shape between the first electrode 26 and the second electrode 28. The conductive film 24 has a mesh pattern of conductive thin metal wires (partially shown) with a large number of lattice intersections. The conductive film 24 may be hereinafter referred to as the mesh pattern 24.

Figure 3A:
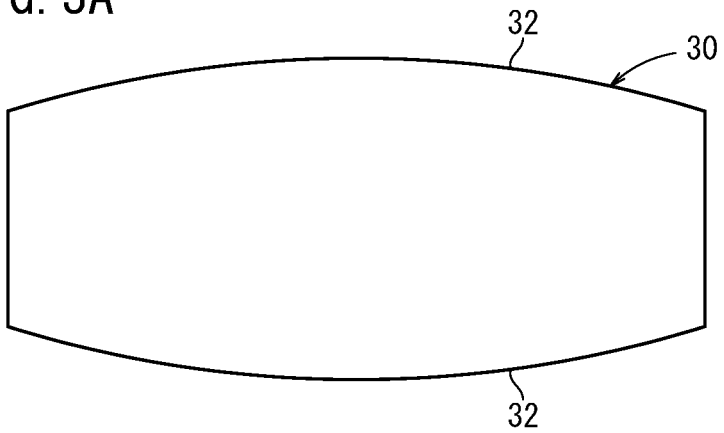
FIGS. 3A to 3C are each an explanatory view showing a projected shape of the entire mesh pattern.
Figure 3B:
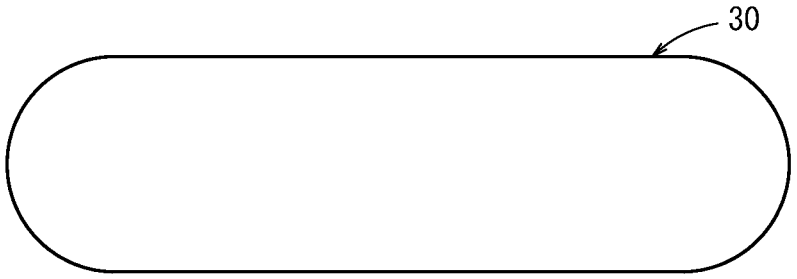
Figure 3C:
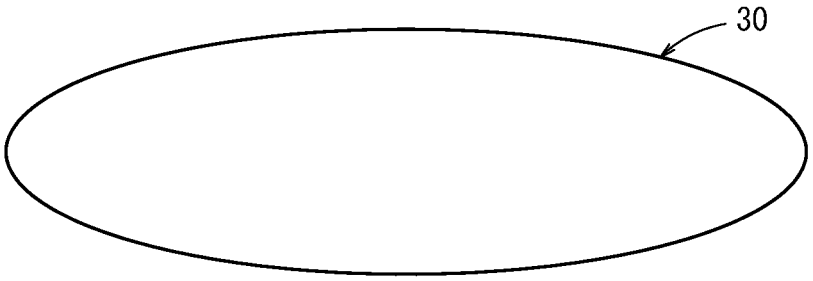

In this embodiment, the overall shape of the mesh pattern in the conductive film 24 may be different from the shape of the front cover 10. For example, as shown in FIG. 2, the projected shape 30 (the shape projected on the opening surface of the front cover 10) of the overall shape of the mesh pattern 24 may be preferably a rectangular shape having long sides between the first electrode 26 and the second electrode 28. Alternatively, as shown in FIG. 3A, the projected shape 30 may be preferably a rectangular shape having curved portions 32 protruding from the long sides integrally. It is to be understood that as shown in FIGS. 3B and 3C, the projected shape 30 may be a track or ellipsoid shape. As shown in FIG. 2, a region contained in the overall shape of the mesh pattern 24 acts as a heat generation region 34 of the heat generator 20.

In this embodiment, when two opposite points in the first electrode 26 and the second electrode 28 are at a distance, Lmin is a minimum value of the distance, and Lmax is a maximum value of the distance, the first electrode 26 and the second electrode 28 satisfy the inequality:

$$(L\max - L\min)/((L\max + L\min)/2) \leq 0.375.$$

Figure 4:
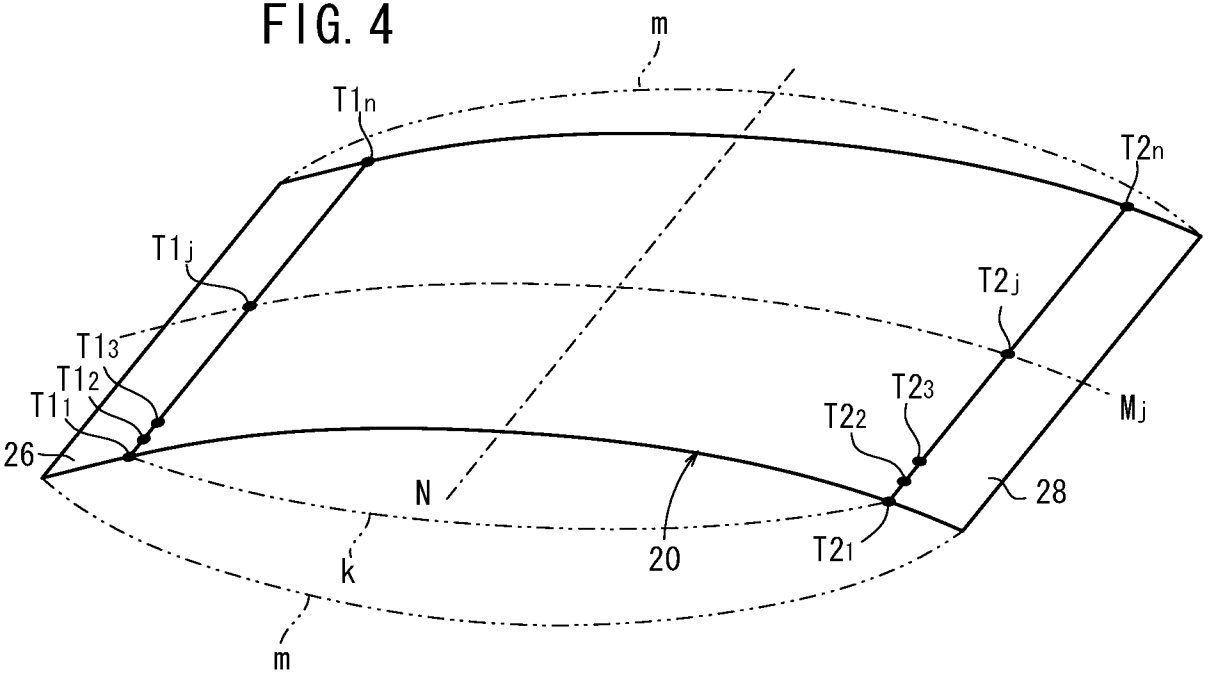
FIG. 4 is an explanatory view showing a distance between two opposite points in the first and second electrodes.

The two opposite points in the first electrode 26 and the second electrode 28 are two points that are line-symmetric with respect to an imaginary centerline N between the first electrode 26 and the second electrode 28. The centerline N is perpendicular to a line $M_j$ between the longitudinal middle point $T1_j$ in the first electrode 26 and the longitudinal middle point $T2_j$ in the second electrode 28. For example, as shown in FIG. 4, the two opposite points include the longitudinal middle point $T1_j$ in the first electrode 26 and the longitudinal middle point $T2_j$ in the second electrode 28, and include the longitudinal end point $T1_n$ in the first electrode 26 and the longitudinal end point $T2_n$ in the second electrode 28. Furthermore, as shown in FIG. 4, the two opposite points include points $T1_1$ and $T2_1$, points $T1_2$ and $T2_2$, points $T1_3$ and $T2_3$, etc. The minimum value Lmin is the shortest distance between such two opposite points, and the maximum value Lmax is the longest distance between such two opposite points. For example, when the projected shape 30 of the mesh pattern 24 is not a rectangular shape but a circular shape corresponding to the shape of the outline of the front cover (shown by a two-dot chain line m), the maximum value Lmax is the distance between the points $T1_1$ and $T2_1$ shown by a two-dot chain line k along the circular shape, and the minimum value Lmin is the shortest distance between the middle points $T1_j$ and $T2_j$.

The finding of the above relation between the minimum value Lmin and the maximum value Lmax and the realization of uniform heat generation in the heat generator formed on a particular position of a three-dimensional curved surface will be described below.

In conventional surface heat generators for rear windows and headlamp covers, a heat generation wire is distributed on the entire surface to be heated. In general, one wire is used in a small heater of the headlamp cover, and at most ten wires are used in a large heater of the rear window. A current flows from one end to the other end of the wire. Therefore, when all the wires are composed of the same material and have the same width and thickness, the heat generation amount depends on the density of the wires. Thus, in the conventional heat generator, uniform heat generation can be achieved by forming the wires at a constant density, regardless of the shape of the region to be heated.

However, the conventional heat generator is disadvantageous in that the heat generation wire is highly visible to the naked eye, resulting in illuminance reduction of the light source. Thus, in this embodiment, the mesh pattern 24 is formed to produce the heat generator 20 with a high transparency. The transparent heat generator 20 having the mesh pattern 24 contains innumerable current pathways, and a current is concentrated in a pathway with a low resistance. Therefore, an idea is required to achieve uniform heat generation.

A method for achieving uniform heat generation in the transparent heat generator 20 (particularly formed on a three-dimensional curved surface) has been found as follows.

Thus, the heat generation region 34 is formed such that the projected shape 30 is an approximately rectangular shape, strip-shaped electrodes (the first electrode 26 and the second electrode 28) are disposed on the opposite sides, and a voltage is applied between the electrodes to flow a current. Though the projected shape 30 cannot be a precise rectangular shape on the three-dimensional curved surface, it is preferred that the projected shape 30 is made closer to the rectangular shape.

When the heat generation wire is arranged in a zigzag manner in the conventional heat generator, a potential difference is generated between the adjacent lines to cause migration disadvantageously. In contrast, in this embodiment, the mesh pattern 24 with a large number of lattice intersections is formed by conductive thin metal wires 22, so that the adjacent wires are intrinsically in the short circuit condition, and the migration is never a problem.

The electrical resistance of the transparent heat generator 20 is increased in proportion to the distance between the first electrode 26 and the second electrode 28 facing each other. Under a constant voltage, the heat generation amount varies in inverse proportion to the electrical resistance. In other words, the heat generation amount is reduced as the electrical resistance is increased. Thus, it is ideal to arrange the first electrode 26 and the second electrode 28 parallel to each other. In the case of heating a particular region on the three-dimensional curved surface, it is preferred that the distance Ln between the two opposite points in the first electrode 26 and the second electrode 28 is within a narrow distance range in any position to uniformly heat the surface.

It is considered that the problem of snow or frost is caused mainly at an ambient temperature of −10° C. to +3° C. At −10° C. or lower, the ambient air is almost free from moisture, and the snow is reduced as well as the frost. At 3° C. or higher, the snow or frost is preferably melted. When the heat generator 20 has a heat generation distribution (variation) of 0, the surface temperature of the front cover 10 can be increased from −10° C. to 3° C. by heating the surface by 13° C. on average. However, when the heat generator 20 has a heat generation distribution (variation) of plus or minus 5° C., it is necessary to heat the surface by 18° C. on average (distributed between 13° C. to 23° C.). The minimum surface temperature of the front cover 10 cannot be increased to 3° C. or higher only by heating the surface by 13° C. on average. Thus, the heat generator 20 having a smaller heat generation distribution (variation) is more advantageous in energy saving.

The temperature increased by the transparent heat generator 20 (the temperature rise range of the transparent heat generator 20) is preferably such that the minimum is 13° C., the maximum is 19° C., and the average is 16° C. In this case, the energy can be preferably reduced by 2° C. as compared with the above described example, resulting in energy saving. In this case, the temperature distribution ratio is (19° C.−13° C.)/16° C.=0.375. Since the heat generation amount approximately corresponds to the distribution of the distance between the two opposite points in the first electrode 26 and the second electrode 28, the equality of (Lmax−Lmin)/((Lmax+Lmin)/2)=0.375 is satisfied, wherein Lmax and Lmin represent a maximum value and a minimum value of the distance respectively.

When the average temperature increased by the transparent heat generator 20 is controlled at 14.5° C., the maximum temperature $T_{max}$ is 14.5−13+14.5=16, and the temperature distribution ratio is (16−13)/14.5=0.207. Therefore, the first electrode 26 and the second electrode 28 may be arranged such that the equality of (Lmax−Lmin)/((Lmax+Lmin)/2)=0.207 is satisfied. In this case, the energy can be preferably reduced by 1.5° C. as compared with the above example using the average temperature of 16° C., thereby being further advantageous in energy saving.

The heat generator 20 preferably has a surface resistance of 10 to 500 ohm/sq. In addition, the heat generator 20 preferably has an electrical resistance of 12 to 120 ohm. In this case, the average temperature increased by the heat generator 20 can be controlled at 16° C., 14.5° C., etc., and the snow or the like attached to the front cover 10 can be removed.

In this embodiment, the thin metal wire 22 in the mesh pattern 24 preferably has a width of 1 to 40 μm. In this case, because the mesh pattern 24 is less visible, the transparency increases. As a result, the illuminance reduction of the light source 14 is prevented.

The thin metal wire 22 in the mesh pattern 24 preferably has a pitch of 0.1 to 50 mm when the thin metal wire 22 has a width of 1 to 40 μm, the heat generator 20 has a surface resistance of 10 to 500 ohm/sq, and the heat generator 20 has an electrical resistance of 12 to 120 ohm.

A method for producing the front cover 10 will be described below with reference to FIGS. 5 to 18.

Figure 5:
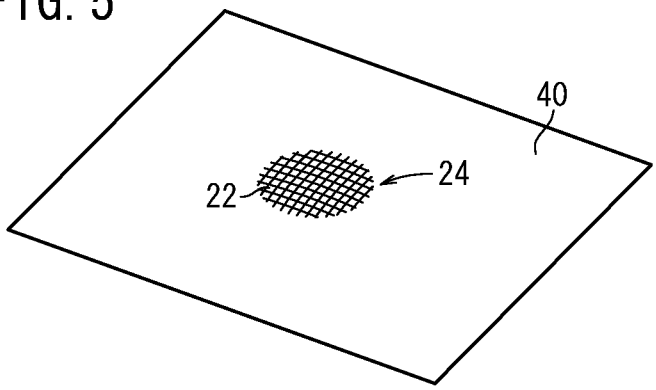
FIG. 5 is a perspective view showing the mesh pattern formed on a transparent film.

First, as shown in FIG. 5, the mesh pattern 24 containing the conductive thin metal wires 22 with a large number of lattice intersections is formed on an insulating transparent film 40.

Figure 6A:
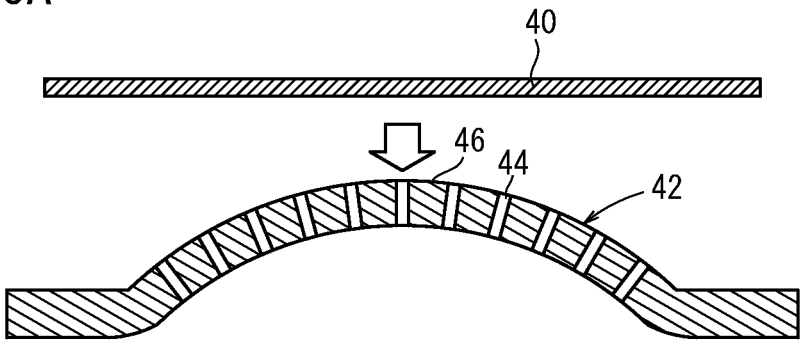
FIG. 6A is a cross-sectional view partially showing a forming mold for forming the transparent film under vacuum.

Then, as shown in FIG. 6A, the transparent film 40 having the mesh pattern 24 is formed under vacuum into a curved surface shape corresponding to the surface shape of the front cover 10. The vacuum forming is carried out using a forming mold 42 having approximately the same size as an injection mold 50 for injection forming of the front cover 10 (see FIG. 14). As shown in FIG. 6A, when the front cover 10 has a three-dimensional curved surface, the forming mold 42 has a similar curved surface (an inverted curved surface in this case) and a plurality of vacuum vents 44. For example, when the front cover 10 has a concave curved surface, the forming mold 42 has such a size that a convex curved surface 46 of the forming mold 42 is fitted into the concave curved surface of the front cover 10.

Figure 6B:
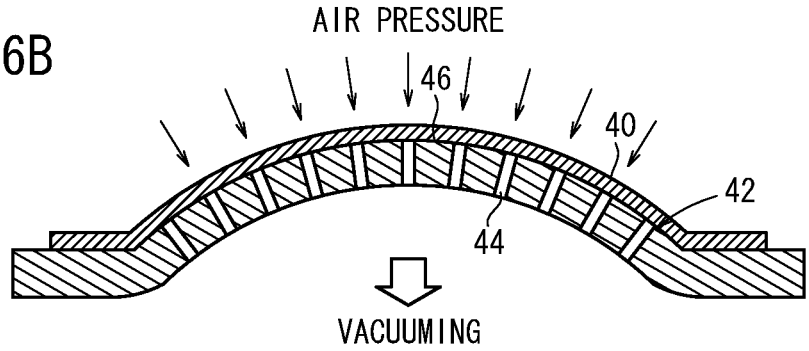
FIG. 6B is a cross-sectional view showing the transparent film pressed to the mold.
Figure 7:
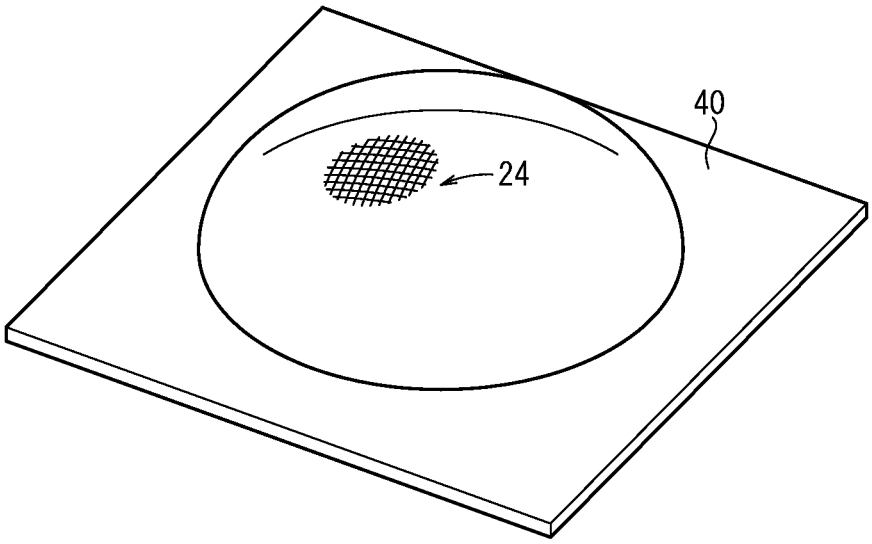
FIG. 7 is a perspective view showing the transparent film formed into a curved surface shape using the forming mold under vacuum.

The vacuum forming of the transparent film 40 may be carried out using the forming mold 42 as follows. As shown in FIG. 6A, the transparent film 40 having the mesh pattern 24 is preheated at 140° C. to 210° C. Then, as shown in FIG. 6B, the transparent film 40 is pressed to the convex curved surface 46 of the forming mold 42, and an air pressure of 0.1 to 2 MPa is applied to the transparent film 40 by vacuuming air through the vacuum vents 44 in the forming mold 42. As shown in FIG. 7, the transparent film 40 having the same curved surface shape as the front cover 10 is obtained by the vacuum forming.

Figure 8:
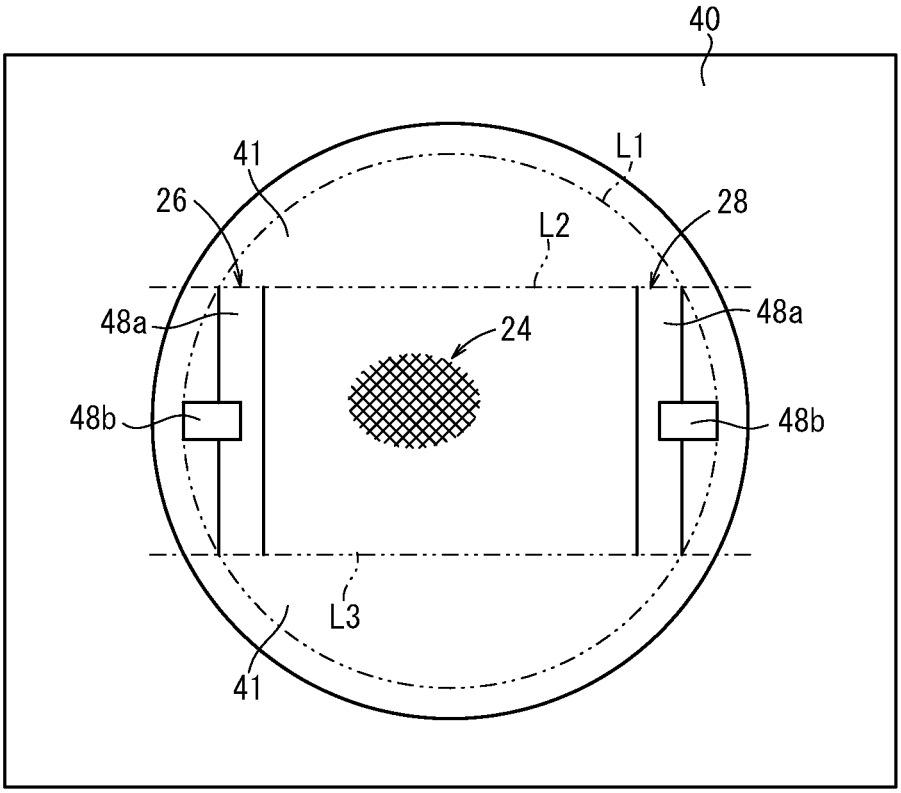
FIG. 8 is a view showing the first and second electrodes formed on the transparent film having the curved surface shape in production of a heat generator according to a first specific example.

As shown in FIG. 8, the first electrode 26 and the second electrode 28 are formed on predetermined positions in the transparent film 40 having the curved surface shape. For example, conductive first copper tapes 48*a* (for forming strip electrodes) are attached to the transparent film 40, and second copper tapes 48*b* (for forming lead-out electrodes) are attached in the direction perpendicular to the first copper tapes 48*a*, to form the first electrode 26 and the second electrode 28. The second copper tapes 48*b* are partially overlapped with the first copper tapes 48*a*.

Figure 9:
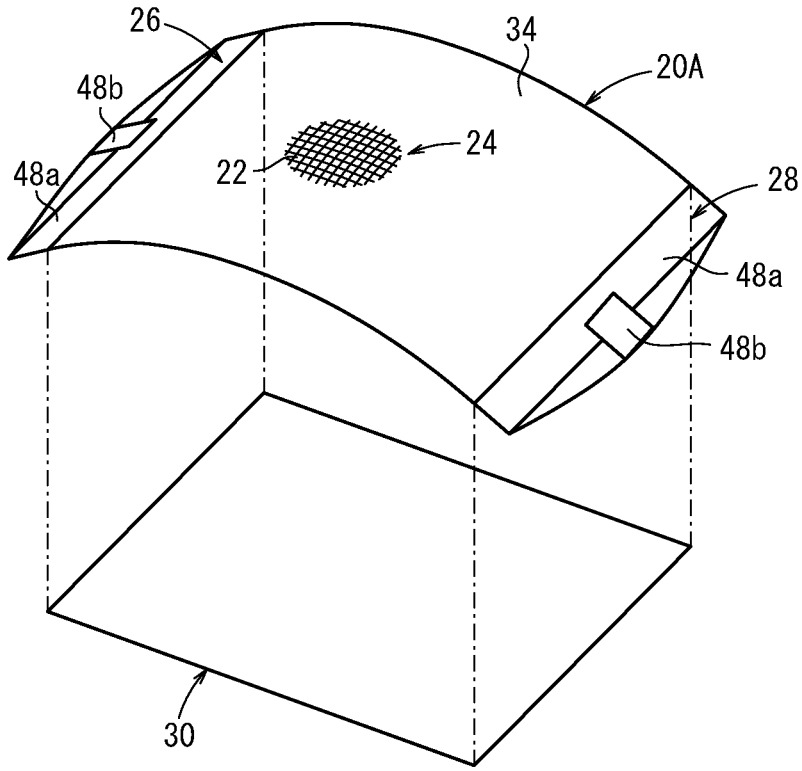
FIG. 9 is a perspective view showing the heat generator of the first specific example produced by partially cutting the transparent film having the curved surface shape.

As shown in FIG. 9, a part of the transparent film 40 having the curved surface shape is cut off. For example, the cutting may be carried out such that the projected shape 30 of the mesh pattern 24 in the transparent film 40 is converted to a rectangular shape while maintaining the first electrode 26 and the second electrode 28. In this embodiment, as shown in FIG. 8, the periphery of the transparent film 40 having the curved surface shape is cut along a cutting line L1 corresponding to the formed shape to obtain a circular projected shape, and curved portions 41 at the ends are cut along cutting lines L2 and L3, while maintaining the first electrode 26 and the second electrode 28. Thus, as shown in FIG. 9, a heat generator 20A according to a first specific example is obtained.

It is to be understood that the first electrode 26 and the second electrode 28 may be formed after partially cutting the transparent film 40 having the curved surface shape.

Figure 10:
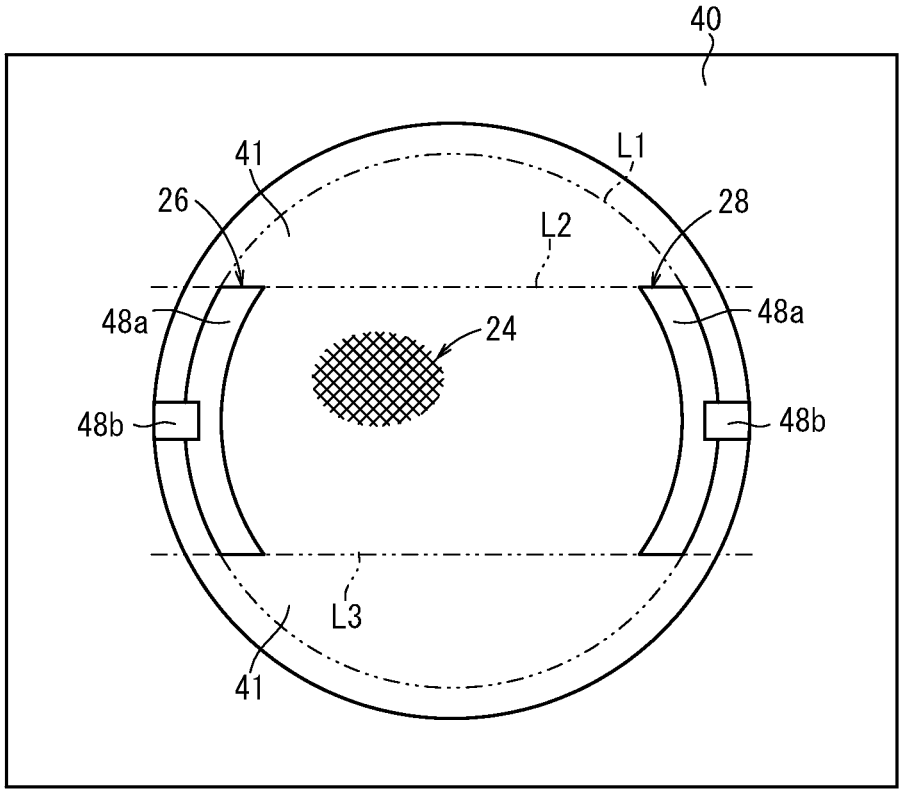
FIG. 10 is a view showing the first and second electrodes formed on the transparent film having the curved surface shape after partially cutting the film in production of a heat generator according to a second specific example.
Figure 11:
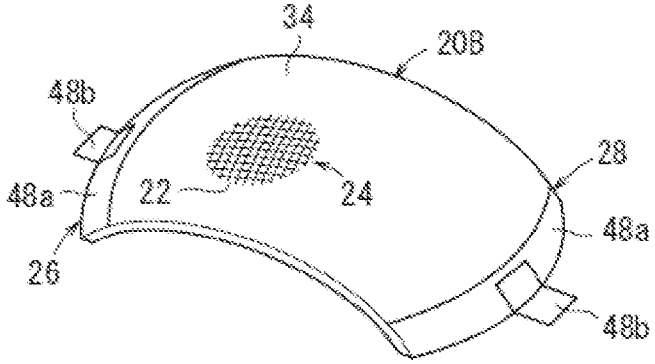
FIG. 11 is a perspective view showing the produced heat generator of the second specific example.

For example, as shown in FIG. 10, the periphery of the transparent film 40 having the curved surface shape is cut along a cutting line L1 corresponding to the formed shape to obtain a circular projected shape, curved portions 41 at the ends are cut along cutting lines L2 and L3, conductive first copper tapes 48*a* (for forming strip electrodes) are attached onto the periphery of the transparent film 40, and second copper tapes 48*b* (for forming lead-out electrodes) are attached in the direction perpendicular to the first copper tapes 48*a* to form the first electrode 26 and the second electrode 28. The second copper tapes 48*b* are partially overlapped with the first copper tapes 48*a*. Thus, as shown in FIG. 11, a heat generator 20B according to a second specific example is obtained.

Figure 12:
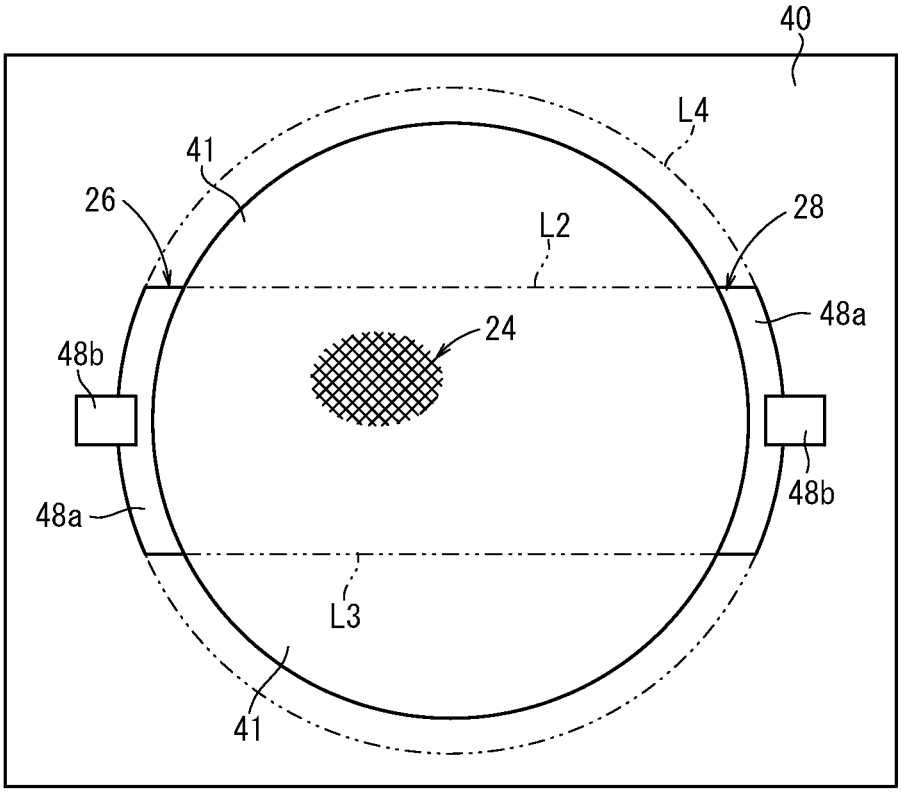
FIG. 12 is a view showing the first and second electrodes formed on the transparent film having the curved surface shape after partially cutting the film in production of a heat generator according to a third specific example.
Figure 13:
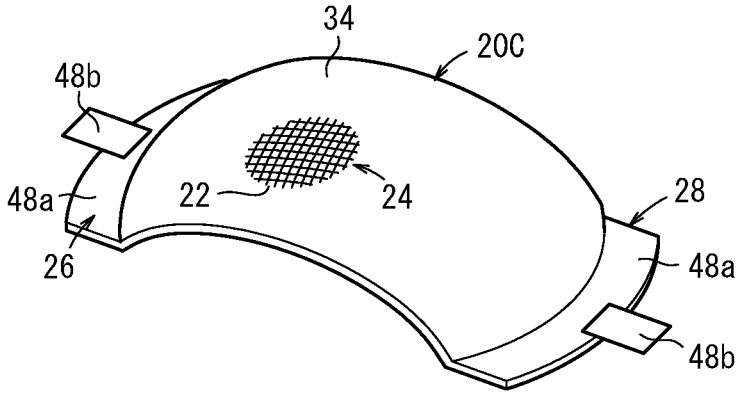
FIG. 13 is a perspective view showing the produced heat generator of the third specific example.

Alternatively, for example, as shown in FIG. 12, the periphery of the transparent film 40 having the curved surface shape is cut along a cutting line L4 to obtain a circular projected shape with a flat surface portion, curved portions at the ends are cut along cutting lines L2 and L3, conductive first copper tapes 48*a* (for forming strip electrodes) are attached to the periphery of the flat surface portion in the transparent film 40, and second copper tapes 48*b* (for forming lead-out electrodes) are attached in the direction perpendicular to the first copper tapes 48*a* to form the first electrode 26 and the second electrode 28. The second copper tapes 48*b* are partially overlapped with the first copper tapes 48*a*. Thus, as shown in FIG. 13, a heat generator 20C according to a third specific example is obtained.

The heat generator 20 shown in FIG. 2 and the heat generators 20A to 20C of the first to third specific examples are hereinafter referred to as the heat generator 20.

Figure 14:
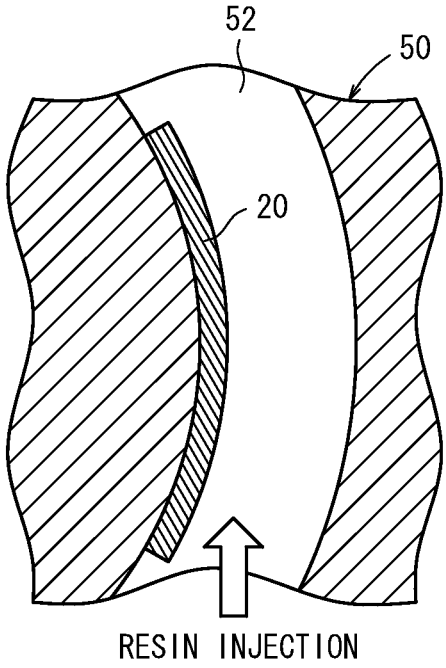
FIG. 14 is a cross-sectional view partially showing the heat generator of the embodiment placed in an injection mold.

As shown in FIG. 14, the heat generator 20 obtained in the above manner is placed in the injection mold 50 for forming the front cover 10.

A melted resin is introduced into a cavity 52 of the injection mold 50, and is hardened therein to obtain the front cover 10 having the integrated heat generator 20 containing the transparent film 40.

Several methods (first to fourth methods) for forming the mesh pattern 24 containing the thin metal wires 22 on the transparent film 40 will be described below with reference to FIGS. 15A to 18.

In the first method, a photosensitive silver salt layer is formed, exposed, developed, and fixed on the transparent film 40, to form metallic silver portions in the mesh pattern.

Figure 15A:
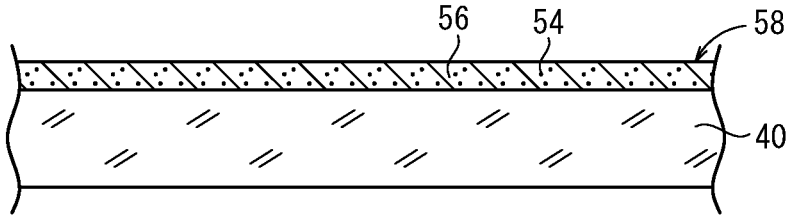
FIGS. 15A to 15E are views showing the process of a method for forming the mesh pattern of the embodiment (a first method)

Specifically, as shown in FIG. 15A, the transparent film 40 is coated with a photosensitive silver salt layer 58 containing a mixture of a gelatin 56 and a silver halide 54 (e.g., silver bromide particles, silver chlorobromide particles, or silver iodobromide particles). Though the silver halide 54 is exaggeratingly shown by points in FIGS. 15A to 15C to facilitate understanding, the points do not represent the size, concentration, etc. of the silver halide 54.

Figure 15B:
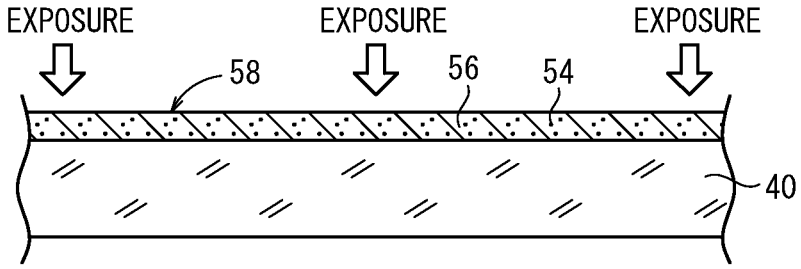

Then, as shown in FIG. 15B, the photosensitive silver salt layer 58 is subjected to an exposure treatment for forming the mesh pattern 24. When an optical energy is applied to the silver halide 54, minute silver nuclei are generated to form an invisible latent image.

Figure 15C:
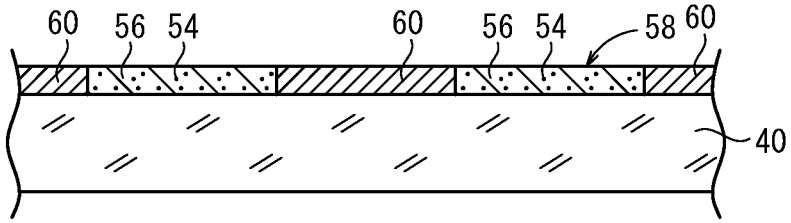

As shown in FIG. 15C, the photosensitive silver salt layer 58 is subjected to a development treatment for converting the latent image to an image visible to the naked eye. Specifically, the photosensitive silver salt layer 58 having the latent image is developed using a developer, which is an alkaline or acidic solution, generally an alkaline solution. In the development treatment, using the latent image silver nuclei as catalyst cores, silver ions from the silver halide particles or the developer are reduced to metallic silver by a reducing agent (a developing agent) in the developer. As a result, the latent image silver nuclei are grown to form a visible silver image (developed silvers 60).

Figure 15D:
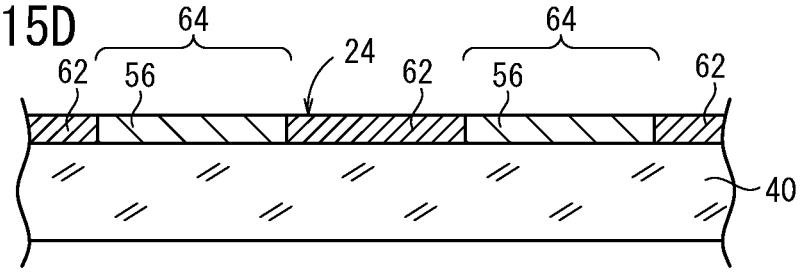

The photosensitive silver halide 54 remains in the photosensitive silver salt layer 58 after the development treatment. As shown in FIG. 15D, the silver halide 54 is removed by a fixation treatment using a fixer, which is an acidic or alkaline solution, generally an acidic solution.

After the fixation treatment, metallic silver portions 62 are formed in exposed areas, and light-transmitting portions 64 containing only the gelatin 56 are formed in unexposed areas. Thus, the mesh pattern 24 is formed by the combination of the metallic silver portions 62 and the light-transmitting portions 64 on the transparent film 40.

In a case where silver bromide is used as the silver halide 54 and a thiosulfate salt is used in the fixation treatment, a reaction represented by the following formula proceeds in the treatment.

$$AgBr\ (solid) + 2S_2O_3\ ions \rightarrow Ag(S_2O_3)_2\ (readily\text{-}water\text{-}soluble\ complex)$$

Two thiosulfate $S_2O_3$ ions and one silver ion in the gelatin 56 (from AgBr) are reacted to generate a silver thiosulfate complex. The silver thiosulfate complex has a high water solubility, and thereby is eluted from the gelatin 56. As a result, the developed silvers 60 are fixed as the metallic silver portions 62. The mesh pattern 24 is formed by the metallic silver portions 62.

Thus, the latent image is reacted with the reducing agent to deposit the developed silvers 60 in the development treatment, and the residual silver halide 54, not converted to the developed silver 60, is eluted into water in the fixation treatment. The treatments are described in detail in T. H. James, "*The Theory of the Photographic Process, 4th ed.*", Macmillian Publishing Co., Inc., NY, Chapter 15, pp. 438-442, 1977.

An alkaline solution is generally used in the development treatment. Therefore, the alkaline solution used in the development treatment may be mixed into the fixer (generally an acidic solution), whereby the activity of the fixer may be disadvantageously changed in the fixation treatment. Further, the developer may remain on the film after removing the film from the development bath, whereby an undesired development reaction may be accelerated by the developer. Thus, it is preferred that the photosensitive silver salt layer 58 is neutralized or acidified by a quencher such as an acetic acid solution after the development treatment before the fixation treatment.

Figure 15E:
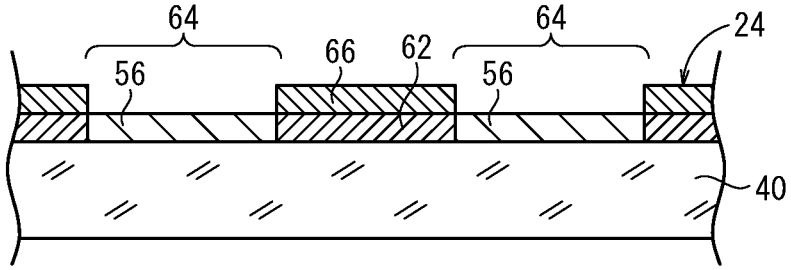

For example, as shown in FIG. 15E, a conductive metal layer 66 may be disposed only on the metallic silver portion 62 by a plating treatment (an electroless plating treatment, an electroplating treatment, or a combination thereof). In this case, the mesh pattern 24 is formed by the metallic silver portions 62 and the conductive metal layers 66 disposed thereon.

Figure 16A:
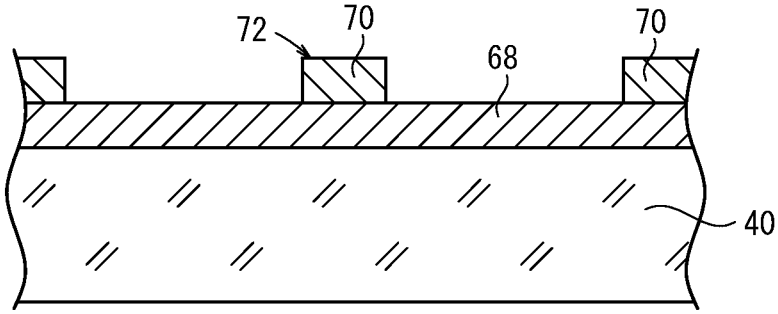
FIGS. 16A and 16B are views showing the process of another method for forming the mesh pattern of the embodiment (a second method)
Figure 16B:
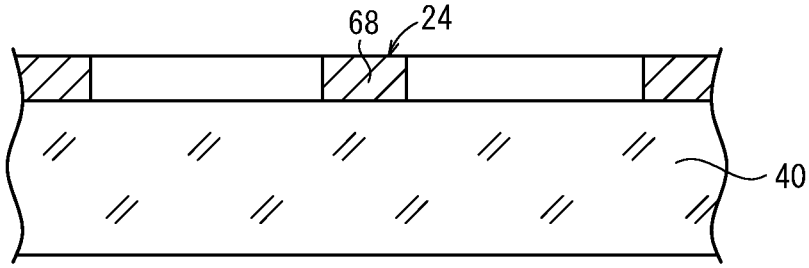

In the second method, for example, as shown in FIG. 16A, a photoresist film 70 is formed on a copper foil 68 disposed on the transparent film 40, and the photoresist film 70 is exposed and developed to form a resist pattern 72. As shown in FIG. 16B, the copper foil 68 exposed from the resist pattern 72 is etched to form the mesh pattern 24 of the copper foil 68.

Figure 17A:
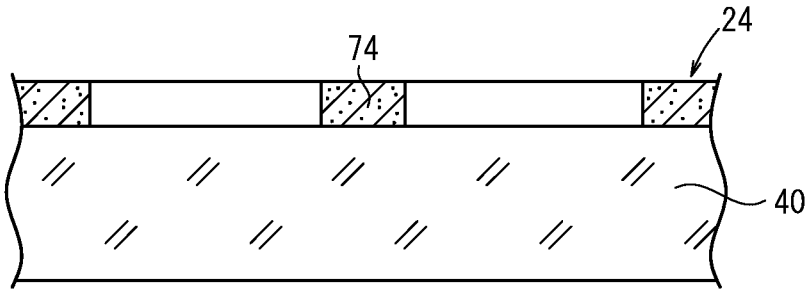
FIGS. 17A and 17B are views showing the process of a further method for forming the mesh pattern of the embodiment (a third method)
Figure 17B:
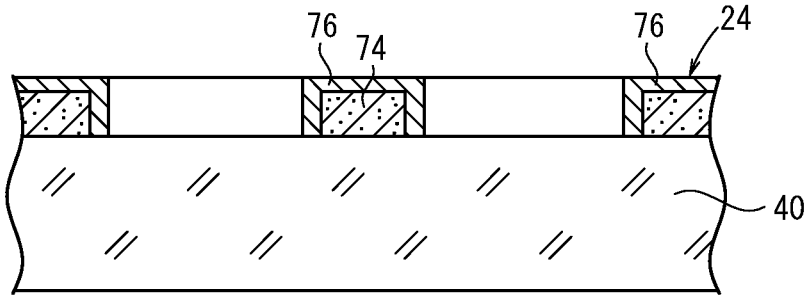

In the third method, as shown in FIG. 17A, a paste 74 containing fine metal particles is printed on the transparent film 40 to form the mesh pattern 24. Of course, as shown in FIG. 17B, the printed paste 74 may be plated with a metal to form a plated metal layer 76. In this case, the mesh pattern 24 is formed by the paste 74 and the plated metal layer 76.

Figure 18:
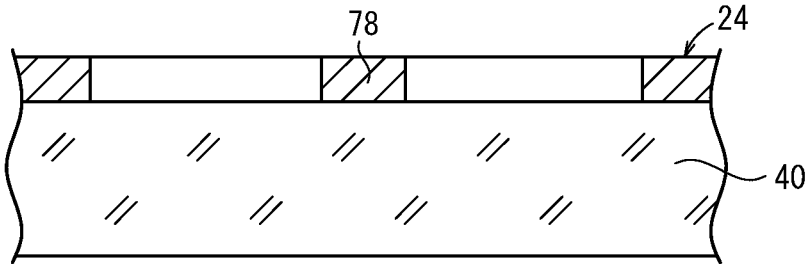
FIG. 18 is a view showing the process of a still further method for forming the mesh pattern of the embodiment (a fourth method)

In the fourth method, as shown in FIG. 18, a thin metal film 78 is printed on the transparent film 40 to form the mesh pattern by using a screen or gravure printing plate.

Among the first to fourth methods, suitable for producing the heat generator 20 having the curved surface shape is the first method containing exposing, developing, and fixing the photosensitive silver salt layer 58 disposed on the transparent film 40 to form the mesh pattern 24 of the metallic silver portions 62.

As described above, in the heat generator 20 and the front cover 10 equipped therewith according to the embodiment, the substantially transparent surface heat generation film can be formed on the curved surface, the heat generation uniformity can be improved, the migration can be prevented, and the transparent heater can be inexpensively formed on the curved surface of the formed body.

Though the heat generator 20 is formed in a part of the surface of the front cover 10 having the entirely curved surface shape in FIG. 1, the front cover 10 may have a partially curved shape and a flat surface. The mesh pattern 24 in the heat generator 20 of the embodiment can be flexibly used on such a partially curved shape. Furthermore, the mesh pattern 24 can be used on a curved surface shape having a minimum curvature radius of 300 mm or less. Thus, the mesh pattern 24 can be satisfactorily used without breaking on various curved surface shapes, even when the heat generator 20 has a curved surface shape with a minimum curvature radius of 300 mm or less.

A particularly preferred method, which contains using a photographic photosensitive silver halide material for forming the mesh pattern 24 in the heat generator 20 of this embodiment, will be mainly described below.

As described above, the mesh pattern 24 in the heat generator 20 of this embodiment may be produced such that a photosensitive material having the transparent film 40 and thereon a photosensitive silver halide-containing emulsion layer is exposed and developed, whereby the metallic silver portions 62 and the light-transmitting portions 64 are formed in the exposed areas and the unexposed areas respectively. The metallic silver portions 62 may be subjected to a physical development treatment and/or a plating treatment to form the conductive metal layer 66 thereon if necessary.

The method for forming the mesh pattern 24 includes the following three processes, different in the photosensitive materials and development treatments.

(1) A process comprising subjecting a photosensitive black-and-white silver halide material free of physical development nuclei to a chemical or physical development, to form the metallic silver portions 62 on the material.

(2) A process comprising subjecting a photosensitive black-and-white silver halide material having a silver halide emulsion layer containing physical development nuclei to a physical development, to form the metallic silver portions 62 on the photosensitive material.

(3) A process comprising subjecting a stack of a photosensitive black-and-white silver halide material free of physical development nuclei and an image-receiving sheet having a non-photosensitive layer containing physical development nuclei to a diffusion transfer development, to form the metallic silver portions 62 on the non-photosensitive image-receiving sheet.

In the process of (1), an integral black-and-white development procedure is used to form a transmittable conductive film such as a light-transmitting electromagnetic-shielding film or a light-transmitting conductive film on the photosensitive material. The resulting silver is a chemically or physically developed silver containing a filament of a high-specific surface area, and shows a high activity in the following plating or physical development treatment.

In the process of (2), the silver halide particles are melted around the physical development nuclei and deposited on the nuclei in the exposed areas, to form a transmittable conductive film on the photosensitive material. Also in this process, an integral black-and-white development procedure is used. Though high activity can be achieved since the silver halide is deposited on the physical development nuclei in the development, the developed silver has a spherical shape with small specific surface.

In the process of (3), the silver halide particles are melted in unexposed areas, and diffused and deposited on the development nuclei of the image-receiving sheet, to form a transmittable conductive film on the sheet. In this process, a so-called separate-type procedure is used, and the image-receiving sheet is peeled off from the photosensitive material.

A negative development treatment or a reversal development treatment can be used in the processes. In the diffusion transfer development, the negative development treatment can be carried out using an auto-positive photosensitive material.

The chemical development, thermal development, solution physical development, and diffusion transfer development have the meanings generally known in the art, and are explained in common photographic chemistry texts such as Shin-ichi Kikuchi, "Shashin Kagaku (*Photographic Chemistry*)", Kyoritsu Shuppan Co., Ltd. and C. E. K. Mees, "*The Theory of Photographic Processes, 4th ed.*", Mcmillan, 1977. A liquid treatment is generally used in the present invention, and also a thermal development treatment can be utilized. For example, techniques described in Japanese Laid-Open Patent Publication Nos. 2004-184693, 2004-334077, and 2005-

010752 and Japanese Patent Application Nos. 2004-244080 and 2004-085655 can be used in the present invention.

(Photosensitive Material)

[Transparent Film 40]

The transparent film 40 used in the production method of the embodiment may be a flexible plastic film.

Examples of materials for the plastic film include polyethylene terephthalates (PET), polyethylene naphthalates (PEN), polyvinyl chlorides, polyvinylidene chlorides, polyvinyl butyrals, polyamides, polyethers, polysulfones, polyether sulfones, polycarbonates, polyarylates, polyetherimides, polyetherketones, polyether ether ketones, polyolefins such as EVA, polycarbonates, triacetyl celluloses (TAC), acrylic resins, polyimides, and aramids.

In this embodiment, the polyethylene terephthalate is preferred as the material for the plastic film from the viewpoints of light transmittance, heat resistance, handling, and cost. The material may be appropriately selected depending on the requirement of heat resistance, heat plasticity, etc. An unstretched PET film is generally used for forming the curved surface shape. However, in the case of producing the photosensitive material according to the embodiment, a stretched PET film is used. The stretched PET film cannot be easily processed into the curved surface shape. Though the unstretched PET film can be processed at about 150° C., the processing temperature of the stretched PET film is preferably 170° C. to 250° C., more preferably 180° C. to 230° C.

The plastic film may have a monolayer structure or a multilayer structure containing two or more layers.

[Protective Layer]

In the photosensitive material, a protective layer may be formed on the emulsion layer to be hereinafter described. The protective layer used in this embodiment contains a binder such as a gelatin or a high-molecular polymer, and is formed on the photosensitive emulsion layer to improve the scratch prevention or mechanical property. In the case of performing the plating treatment, it is preferred that the protective layer is not formed or is formed with a small thickness. The thickness of the protective layer is preferably 0.2 μm or less. The method of applying or forming the protective layer is not particularly limited, and may be appropriately selected from known coating methods.

[Emulsion Layer]

The photosensitive material used in the production method of this embodiment preferably has the transparent film 40 and thereon the emulsion layer containing the silver salt as a light sensor (the silver salt-containing layer 58). The emulsion layer according to the embodiment may contain a dye, a binder, a solvent, etc. in addition to the silver salt, if necessary.

<Silver Salt>

The silver salt used in this embodiment is preferably an inorganic silver salt such as a silver halide. It is particularly preferred that the silver salt is used in the form of particles for the photographic photosensitive silver halide material. The silver halide has an excellent light sensing property.

The silver halide, preferably used in the photographic emulsion of the photographic photosensitive silver halide material, will be described below.

In this embodiment, the silver halide is preferably used as a light sensor. Silver halide technologies for photographic silver salt films, photographic papers, print engraving films, emulsion masks for photomasking, and the like may be utilized in this embodiment.

The silver halide may contain a halogen element of chlorine, bromine, iodine, or fluorine, and may contain a combination of the elements. For example, the silver halide preferably contains AgCl, AgBr, or AgI, more preferably contains AgBr or AgCl, as a main component. Also silver chlorobromide, silver iodochlorobromide, or silver iodobromide is preferably used as the silver halide. The silver halide is further preferably silver chlorobromide, silver bromide, silver iodochlorobromide, or silver iodobromide, most preferably silver chlorobromide or silver iodochlorobromide having a silver chloride content of 50 mol % or more.

The term "the silver halide contains AgBr (silver bromide) as a main component" means that the mole ratio of bromide ion is 50% or more in the silver halide composition. The silver halide particle containing AgBr as a main component may contain iodide or chloride ion in addition to the bromide ion.

The silver halide emulsion used in this embodiment may contain a metal of Group VIII or VIIB. It is particularly preferred that the emulsion contains a rhodium compound, an iridium compound, a ruthenium compound, an iron compound, an osmium compound, or the like to achieve four or more tones and low fogging.

The silver halide emulsion may be effectively doped with a hexacyano-metal complex such as $K_4[Fe(CN)_6]$, $K_4[Ru(CN)_6]$, or $K_3[Cr(CN)_6]$ for increasing the sensitivity.

The amount of the compound added per 1 mol of the silver halide is preferably $10^{-10}$ to $10^{-2}$ mol/mol Ag, more preferably $10^{-9}$ to $10^{-3}$ mol/mol Ag.

Further, in this embodiment, the silver halide may preferably contain Pd (II) ion and/or Pd metal. Pd is preferably contained in the vicinity of the surface of the silver halide particle though it may be uniformly distributed therein. The term "Pd is contained in the vicinity of the surface of the silver halide particle" means that the particle has a layer with a higher palladium content in a region of 50 nm or less in the depth direction from the surface.

Such silver halide particle can be prepared by adding Pd during the particle formation. Pd is preferably added after the silver ion and halogen ion are respectively added by 50% or more of the total amounts. It is also preferred that Pd (II) ion is added in an after-ripening process to obtain the silver halide particle containing Pd near the surface.

The Pd-containing silver halide particle acts to accelerate the physical development and electroless plating, improve production efficiency of the desired heat generator, and lower the production cost. Pd is well known and used as an electroless plating catalyst. In the present invention, Pd can be located in the vicinity of the surface of the silver halide particle, so that the amount of the remarkably expensive Pd can be reduced.

In this embodiment, the content of the Pd ion and/or Pd metal per 1 mol of silver in the silver halide is preferably $10^{-4}$ to 0.5 mol/mol Ag, more preferably 0.01 to 0.3 mol/mol Ag.

Examples of Pd compounds used include $PdCl_4$ and $Na_2PdCl_4$.

In this embodiment, the sensitivity as the light sensor may be further increased by chemical sensitization, which is generally used for photographic emulsions. Examples of the chemical sensitization methods include chalcogen sensitization methods (such as sulfur, selenium, and tellurium sensitization methods), noble metal sensitization methods (such as gold sensitization methods), and reduction sensitization methods. The methods may be used singly or in combination. Preferred combinations of the chemical sensitization methods include combinations of a sulfur sensitization method and a gold sensitization method, combinations of a sulfur sensitization method, a selenium sensitization method, and a gold sensitization method, and combinations of a sulfur sensitization method, a tellurium sensitization method, and a gold sensitization method.

<Binder>

The binder may be used in the emulsion layer to uniformly disperse the silver salt particles and to help the emulsion layer adhere to a support. In the present invention, the binder may contain a water-insoluble or water-soluble polymer, and preferably contains a water-soluble polymer.

Examples of the binders include gelatins, polyvinyl alcohols (PVA), polyvinyl pyrolidones (PVP), polysaccharides such as starches, celluloses and derivatives thereof, polyethylene oxides, polysaccharides, polyvinylamines, chitosans, polylysines, polyacrylic acids, polyalginic acids, polyhyaluronic acids, and carboxycelluloses. The binders show a neutral, anionic, or cationic property due to the ionicity of a functional group.

The amount of the binder in the emulsion layer is controlled preferably such that the Ag/binder volume ratio of the silver salt-containing layer is ¼ or more, more preferably such that the Ag/binder volume ratio is ½ or more.

<Solvent>

The solvent used for forming the emulsion layer is not particularly limited, and examples thereof include water, organic solvents (e.g. alcohols such as methanol, ketones such as acetone, amides such as formamide, sulfoxides such as dimethyl sulfoxide, esters such as ethyl acetate, ethers), ionic liquids, and mixtures thereof.

In the present invention, the mass ratio of the solvent to the total of the silver salt, the binder, and the like in the emulsion layer is 30% to 90% by mass, preferably 50% to 80% by mass.

The treatments for forming the mesh pattern 24 will be described below.

[Exposure]

In this embodiment, the photosensitive material having the silver salt-containing layer 58 formed on the transparent film 40 is subjected to an exposure treatment. The exposure may be carried out using an electromagnetic wave. For example, a light (such as a visible light or an ultraviolet light) or a radiation ray (such as an X-ray) may be used to generate the electromagnetic wave. The exposure may be carried out using a light source having a wavelength distribution or a specific wavelength.

The exposure for forming a pattern image may be carried out using a surface exposure method or a scanning exposure method. In the surface exposure method, the photosensitive surface is irradiated with a uniform light through a mask to form an image of a mask pattern. In the scanning exposure method, the photosensitive surface is scanned with a beam of a laser light or the like to form a patterned irradiated area.

In this embodiment, various laser beams can be used in the exposure. For example, a monochromatic high-density light of a gas laser, a light-emitting diode, a semiconductor laser, or a second harmonic generation (SHG) light source containing a nonlinear optical crystal in combination with a semiconductor laser or a solid laser using a semiconductor laser as an excitation source can be preferably used for the scanning exposure. Also a KrF excimer laser, an ArF excimer laser, an F2 laser, or the like can be used in the exposure. It is preferred that the exposure is carried out using the semiconductor laser or the second harmonic generation (SHG) light source containing the nonlinear optical crystal in combination with the semiconductor laser or the solid laser to reduce the size and costs of the system. It is particularly preferred that the exposure is carried out using the semiconductor laser from the viewpoints of reducing the size and costs and improving the durability and stability of the apparatus.

It is preferred that the silver salt-containing layer 58 is exposed in the pattern by the scanning exposure method using the laser beam. A capstan-type laser scanning exposure apparatus described in Japanese Laid-Open Patent Publication No. 2000-39677 is particularly preferably used for this exposure. In the capstan-type apparatus, a DMD described in Japanese Laid-Open Patent Publication No. 2004-1224 is preferably used instead of a rotary polygon mirror in the optical beam scanning system. Particularly in the case of producing a long flexible film heater having a length of 3 m or more, the photosensitive material is preferably exposed to a laser beam on a curved exposure stage while conveying the material.

The structure of the mesh pattern 24 is not particularly limited as long as a current can flow between the electrodes under an applied voltage. The mesh pattern 24 may be a lattice pattern of triangle, quadrangle (e.g., rhombus, square), hexagon, etc. formed by crossing straight thin wires substantially parallel to each other. Furthermore, the mesh pattern 24 may be a pattern of straight, zigzag, or wavy wires parallel to each other.

[Development Treatment]

In this embodiment, the emulsion layer is subjected to a development treatment after the exposure. Common development treatment technologies for photographic silver salt films, photographic papers, print engraving films, emulsion masks for photomasking, and the like may be used in the present invention. A developer for the development treatment is not particularly limited, and may be a PQ developer, an MQ developer, an MAA developer, etc. Examples of commercially available developers usable in the present invention include CN-16, CR-56, CP45X, FD-3, and PAPITOL available from FUJIFILM Corporation; C-41, E-6, RA-4, D-19, and D-72 available from Eastman Kodak Company; and developers contained in kits thereof. The developer may be a lith developer.

Examples of the lith developers include D85 available from Eastman Kodak Company. In the present invention, by the exposure and development treatments, the metallic silver portion (preferably the patterned metallic silver portion) is formed in the exposed area, and the light-transmitting portion is formed in the unexposed area.

The developer for the development treatment may contain an image quality improver for improving the image quality. Examples of the image quality improvers include nitrogen-containing heterocyclic compounds such as benzotriazole. Particularly, a polyethylene glycol is preferably used for the lith developer.

The mass ratio of the metallic silver contained in the exposed area after the development to the silver contained in this area before the exposure is preferably 50% or more, more preferably 80% or more by mass. When the mass ratio is 50% by mass or more, a high conductivity can be easily achieved.

In this embodiment, the tone (gradation) obtained by the development is preferably more than 4.0, though not particularly restrictive. When the tone after the development is more than 4.0, the conductivity of the conductive metal portion can be increased while maintaining high transmittance of the light-transmitting portion. For example, the tone of 4.0 or more can be achieved by doping with rhodium or iridium ion.

[Physical Development and Plating Treatment]

In this embodiment, to increase the conductivity of the metallic silver portion 62 formed by the exposure and development, conductive metal particles may be deposited thereon by a physical development treatment and/or a plating treatment. Though the conductive metal particles can be deposited on the metallic silver portion 62 by only one of the physical development and plating treatments, the physical development and plating treatments may be used in combination.

In this embodiment, the physical development is such a process that metal ions such as silver ions are reduced by a reducing agent, whereby metal particles are deposited on nuclei of a metal or metal compound. Such physical development has been used in the fields of instant B & W film, instant slide film, printing plate production, etc., and the technologies can be used in the present invention.

The physical development may be carried out at the same time as the above development treatment after the exposure, and may be carried out after the development treatment separately.

The present invention may be appropriately combined with technologies described in the following patent publications: Japanese Laid-Open Patent Publication Nos. 2004-221564, 2004-221565, 2007-200922, and 2006-352073; International Patent Publication No. 2006/001461; Japanese Laid-Open Patent Publication Nos. 2007-129205, 2008-251417, 2007-235115, 2007-207987, 2006-012935, 2006-010795, 2006-228469, 2006-332459, 2007-207987, and 2007-226215; International Patent Publication No. 2006/088059; Japanese Laid-Open Patent Publication Nos. 2006-261315, 2007-072171, 2007-102200, 2006-228473, 2006-269795, 2006-267635, and 2006-267627; International Patent Publication No. 2006/098333; Japanese Laid-Open Patent Publication Nos. 2006-324203, 2006-228478, 2006-228836, and 2006-228480; International Patent Publication Nos. 2006/098336 and 2006/098338; Japanese Laid-Open Patent Publication Nos. 2007-009326, 2006-336057, 2006-339287, 2006-336090, 2006-336099, 2007-039738, 2007-039739, 2007-039740, 2007-002296, 2007-084886, 2007-092146, 2007-162118, 2007-200872, 2007-197809, 2007-270353, 2007-308761, 2006-286410, 2006-283133, 2006-283137, 2006-348351, 2007-270321, and 2007-270322; International Patent Publication No. 2006/098335; Japanese Laid-Open Patent Publication Nos. 2007-088218, 2007-201378, and 2007-335729; International Patent Publication No. 2006/098334; Japanese Laid-Open Patent Publication Nos. 2007-134439, 2007-149760, 2007-208133, 2007-178915, 2007-334325, 2007-310091, 2007-311646, 2007-013130, 2006-339526, 2007-116137, 2007-088219, 2007-207883, 2007-207893, 2007-207910, and 2007-013130; International Patent Publication No. 2007/001008; Japanese Laid-Open Patent Publication Nos. 2005-302508 and 2005-197234.

The heat generator of the embodiment can be used in an electric heating structure for various applications (such as windows of vehicles, aircrafts, and buildings). Examples of the electric heating structures include electric heating windows of vehicles, aircrafts, buildings, etc.

EXAMPLES

The present invention will be described more specifically below with reference to Examples. Materials, amounts, ratios, treatment contents, treatment procedures, and the like, used in Examples, may be appropriately changed without departing from the scope of the present invention. The following specific examples are therefore to be considered in all respects as illustrative and not restrictive.

First Example

To evaluate the advantageous effects of the heat generator 20 of the above embodiment, heat generator-containing front covers of Example 1 and Reference Example 1 were produced, and the distance between electrodes and the temperature distribution of each front cover were measured.

Example 1

Formation of Mesh Pattern 24 (Exposure and Development of Photosensitive Silver Salt Layer)

An emulsion containing an aqueous medium, a gelatin, and silver iodobromide particles was prepared. The silver iodobromide particles had an I content of 2 mol % and an average spherical equivalent diameter of 0.05 μm, and the amount of the gelatin was 7.5 g per 60 g of Ag (silver). The emulsion had an Ag/gelatin volume ratio of 1/1, and the gelatin had a low average molecular weight of 20000.

$K_3Rh_2Br_9$ and $K_2IrCl_6$ were added to the emulsion at a concentration of $10^{-7}$ mol/mol-silver to dope the silver bromide particles with Rh and Ir ions. $Na_2PdCl_4$ was further added to the emulsion, and the resultant emulsion was subjected to gold-sulfur sensitization using chlorauric acid and sodium thiosulfate. The emulsion and a gelatin hardening agent were applied to a polyethylene terephthalate (PET) such that the amount of the applied silver was 1 g/m$^2$. The surface of the PET was hydrophilized before the application. The coating was dried and exposed to an ultraviolet lamp using a photomask having a lattice-patterned space (line/space=285 μm/15 μm (pitch 300 μm)). The photomask was capable of forming a patterned developed silver image (line/space=15 μm/285 μm). Then, the coating was developed using the following developer at 25° C. for 45 seconds, fixed using the fixer SUPER FUJIFIX available from FUJIFILM Corporation, and rinsed with pure water. Thus obtained transparent film 40 having a mesh pattern 24 had a surface resistance of 40 ohm/sq.

[Developer Composition]

1 L of the developer contained the following compounds.

| | |
|---|---|
| Hydroquinone | 0.037 mol/L |
| N-methylaminophenol | 0.016 mol/L |
| Sodium metaborate | 0.140 mol/L |
| Sodium hydroxide | 0.360 mol/L |
| Sodium bromide | 0.031 mol/L |
| Potassium metabisulfite | 0.187 mol/L |

<Vacuum Forming>

The above transparent film 40 having the mesh pattern 24 was formed under vacuum using a forming mold 42 (see FIGS. 6A and 6B). The forming mold 42 had a diameter of 110 mm and a shape provided by cutting off a part of a sphere having a radius of 100 mm. In the vacuum forming, the transparent film 40 was preheated for 5 seconds by a hot plate at 195° C. and then immediately pressed onto the forming mold 42, and an air pressure of 0.7 MPa was applied to on the side of the transparent film 40 while vacuuming from the forming mold 42. Thus, the transparent film 40 having an entirely curved surface shape was obtained.

<Formation of First Electrode 26 and Second Electrode 28>

A conductive copper tape having a width of 12.5 mm and a length of 70 mm (a first copper tape 48*a*, No. 8701 available from Sliontec Corporation, throughout Examples) was attached to each of the opposite ends of the transparent film 40 having the curved surface shape. The first copper tapes 48*a* were arranged approximately parallel to each other. A conductive copper tape having a width of 15 mm and a length of 25 mm (a second copper tape 48*b*) was further attached in the direction perpendicular to each first copper tape 48*a*. The second copper tapes 48*b* were partially overlapped with the first copper tapes 48*a*. Thus, a pair of electrodes (a first electrode 26 and a second electrode 28) were formed.

<Cutting Treatment: Production of Heat Generator 20>

As shown in FIG. 8, the periphery of the transparent film 40 having the curved surface shape, on which the mesh pattern 24, the first electrode 26, and the second electrode 28 were formed, was cut along a cutting line L1 corresponding to the formed shape while maintaining the first electrode 26 and the second electrode 28, to obtain a circular projected shape having a diameter of 110 mm. Furthermore, 20-mm curved portions 41 at the ends are cut along cutting lines L2 and L3 while maintaining the first electrode 26 and the second electrode 28. Thus, as shown in FIG. 9, a heat generator 20A having a curved surface shape was produced. The heat generator 20A had an approximately rectangular projected shape, and had the first electrode 26 and the second electrode 28 on the short sides.

<Injection Forming: Production of Front Cover 10>

Figure 19:
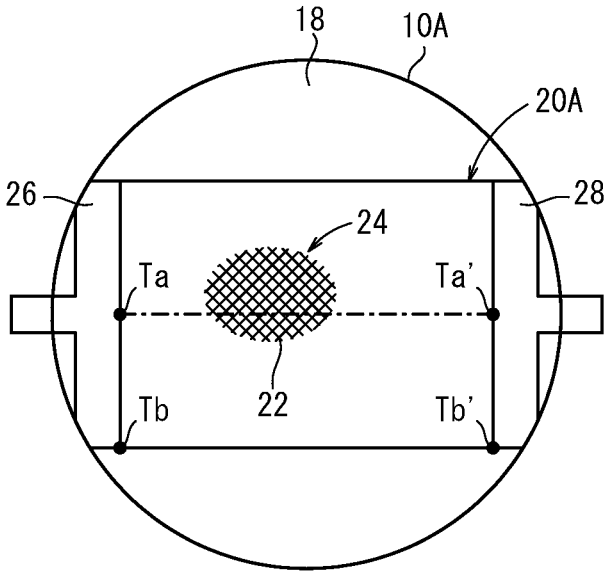
FIG. 19 is a plan view showing a front cover according to Example 1.

As shown in FIG. 14, the heat generator 20 having the curved surface shape was placed in an injection mold 50 for forming a front cover 10, and a polycarbonate melted at 300° C. was introduced into a cavity 52 thereof. Thus, as shown in FIG. 19, a front cover 10A according to Example 1 having a thickness of 2 mm was produced. The injection mold 50 was used under a temperature of 95° C. and a forming cycle of 60 seconds.

Reference Example 1

Figure 20:
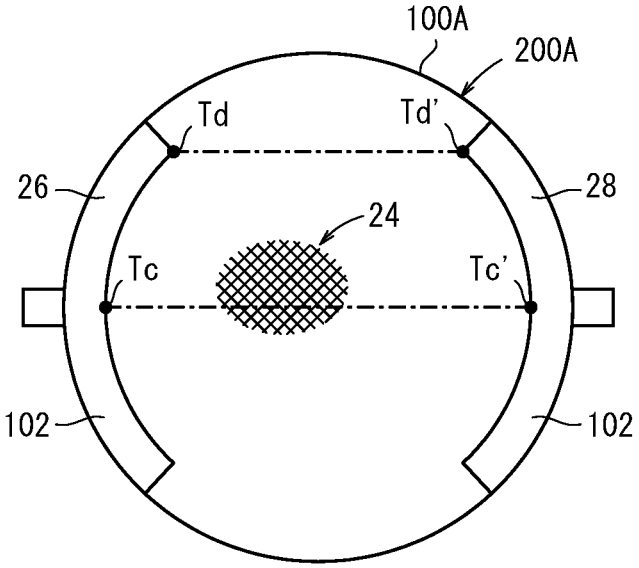
FIG. 20 is a plan view showing a front cover according to Reference Example 1.

A transparent film 40 having a curved surface shape was produced in the same manner as Example 1. Then, instead of the conductive copper tapes (the first copper tapes 48*a*) having a width of 12.5 mm and a length of 70 mm, conductive copper tapes 102 were attached to the opposite circumference portions to form a first electrode 26 and a second electrode 28 having an arc shape with a length of approximately 80 mm. A heat generator 200A having a circular projected shape was produced without cutting end curved portions 41 of the transparent film 40, and was insert-formed. Thus, as shown in FIG. 20, a front cover 100A according to Reference Example 1 was produced.

(Evaluation)

In each front cover, the minimum value Lmin and the maximum value Lmax of the distance between the first electrode 26 and the second electrode 28 (the electrode distance) were measured, and the parameter Pm was obtained using the following expression:

$$Pm=(L\max-L\min)/((L\max+L\min)/2).$$

As shown in FIG. 19, in Example 1, the maximum value Lmax of the distance between the electrodes was the length of an arc between the points Ta and Ta' (shown by a dashed-dotted line, protruded frontward in the drawing, throughout Examples), and the minimum value Lmin of the electrode distance was the length of an arc between the points Tb and Tb'. The front cover 10A of Example 1 had a maximum value Lmax of 70 mm and a minimum value Lmin of 66 mm, and thus had a parameter Pm of 0.059 obtained using the above expression.

On the other hand, as shown in FIG. 20, in Reference Example 1, the maximum value Lmax of the distance between the electrodes was the length of an arc between the points Tc and Tc', and the minimum value Lmin of the electrode distance was the length of an arc between the points Td and Td'. The front cover 100A of Reference Example 1 had a maximum value Lmax of 105 mm and a minimum value Lmin of 50 mm, and thus had a parameter Pm of 0.710 obtained using the above expression.

Figure 21:
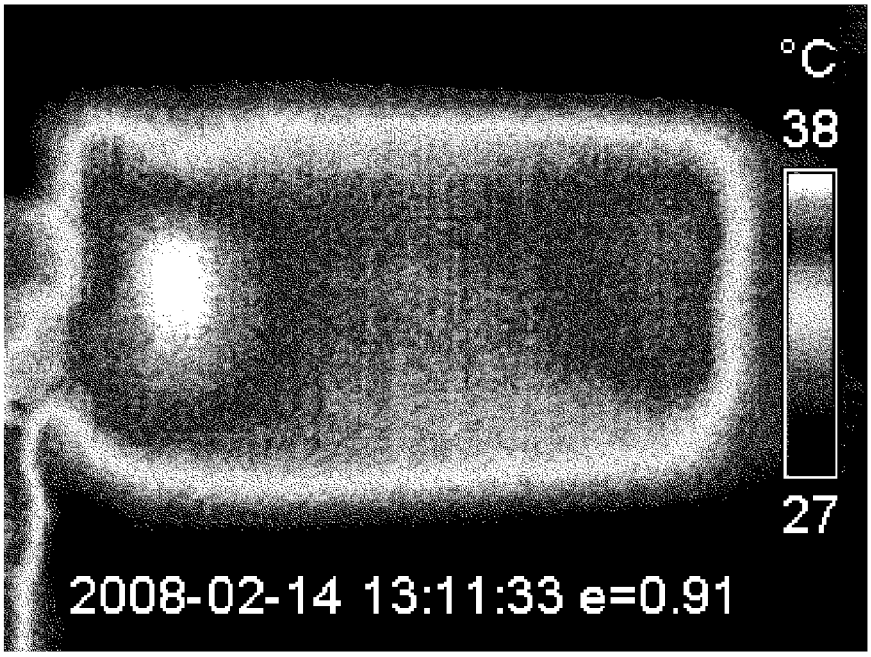
FIG. 21 is a chart showing a temperature distribution of a heat generator according to Example 1.
Figure 22:
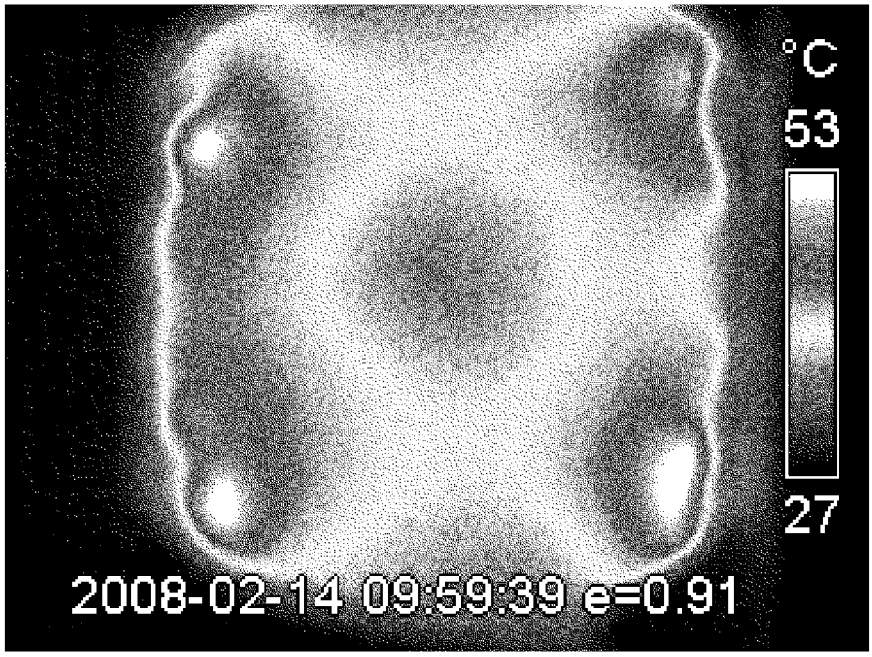
FIG. 22 is a chart showing a temperature distribution of a heat generator according to Reference Example 1.

In each of the front cover 10A of Example 1 and the front cover 100A of Reference Example 1, a direct voltage was applied between the first electrode 26 and the second electrode 28. After the voltage was applied for 10 minutes, the cover surface temperature was measured by an infrared thermometer to evaluate the temperature distribution. The measurement was carried out at the room temperature of 20° C. The results of the temperature distribution measurement are shown in FIGS. 21 and 22, and the measured temperatures (the minimum and maximum temperatures) and the temperature rises (the minimum, maximum, and average rises) are shown in Table 1. The temperature distribution of Example 1 is shown in FIG. 21, and that of Reference Example 1 is shown in FIG. 22.

TABLE 1

| | Measured temperature (° C.) | | | Temperature rise (° C.) | | | Electrode distance (mm) | | |
|---|---|---|---|---|---|---|---|---|---|
| | Minimum | Maximum | Difference | Minimum | Maximum | Average | Lmax | Lmin | Pm |
| Example 1 | 33 | 38 | 5 | 13 | 18 | 15.5 | 70 | 66 | 0.059 |
| Reference Example 1 | 33 | 53 | 20 | 13 | 33 | 23.0 | 105 | 50 | 0.710 |

The front cover 10A of Example 1 exhibited a difference of approximately 5° C. between the minimum and maximum temperatures, a minimum temperature rise of 13° C., a maximum temperature rise of 18° C., and an average temperature rise of 15.5° C. In Example 1, the energy could be reduced by 2.5° C. as compared with an example requiring a temperature rise of 18° C. on average, thereby being advantageous in energy saving. In addition, as shown in FIG. 21, the heat generation was uniformly caused in the entire heat generator.

In contrast with Example 1, the front cover 100A of Reference Example 1 exhibited a larger difference of 20° C. between the minimum and maximum temperatures, a larger average temperature rise of 23.0° C., a minimum temperature rise of 13° C., a maximum temperature rise of 33° C., and a larger variation. In addition, as shown in the temperature distribution of FIG. 22, the heat generation was caused only in the vicinity of the ends of the first and second electrodes and was hardly caused in the center.

As is clear from the above results, the heat generator of Example 1 satisfying the inequality of $Pm \leq 0.375$ exhibited uniform heat generation on the entire surface, unlike the heat generator of Reference Example 1 not satisfying the inequality.

Second Example

To evaluate the advantageous effects of the heat generator 20 of the above embodiment, heat generator-containing front covers of Examples 2 to 5 and Reference Example 2 were produced, and the distance between the electrodes and the difference between minimum and maximum temperatures of each front cover were measured.

Figure 23:
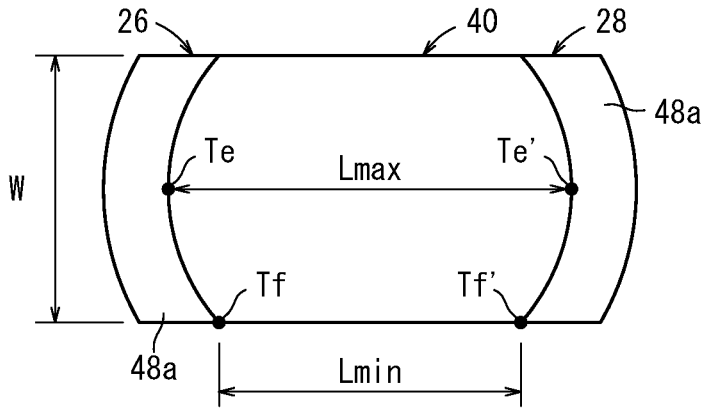
FIG. 23 is a plan view showing first and second electrodes formed on a transparent film having a curved surface shape in production of front covers according to Examples 2 to 5 and Reference Example 2.

In each of the front covers of Examples 2 to 5 and Reference Example 2, the difference between the minimum and maximum temperatures was measured. In Examples 2 to 5 and Reference Example 2, a transparent film 40 having a mesh pattern 24 was formed under vacuum using a forming mold 42 (see FIGS. 6A and 6B) in the same manner as in Example 1. The forming mold 42 had a diameter of 173 mm and a shape provided by cutting off a part of a sphere having a radius of 100 mm. As shown in FIG. 10, the periphery of the transparent film 40 having the curved surface shape was cut along a cutting line L1 corresponding to the formed shape to obtain a circular projected shape, and curved portions 41 at the ends are cut along cutting lines L2 and L3. Thus, as shown in FIG. 23, transparent films 40 according to Examples 2 to 5 and Reference Example 2 were prepared. The width W was 60 mm in Example 2, 80 mm in Example 3, 90 mm in Example 4, 110 mm in Example 5, and 130 mm in Reference Example 2.

Then, as shown in FIG. 23, conductive copper tapes having a width of 15 mm (first copper tapes 48*a*) were attached to the opposite circumference portions of the transparent film 40 to form a first electrode 26 and a second electrode 28. Thus obtained heat generator was injection-formed in the same manner as Example 1, whereby heater-integrated-type front covers according to Examples 2 to 5 and Reference Example 2 were produced respectively.

(Evaluation)

Also in each of the front covers, the minimum value Lmin and the maximum value Lmax of the distance between the first electrode 26 and the second electrode 28 (the electrode distance) were measured, and the parameter Pm was obtained using the following expression:

$$Pm=(L\max-L\min)/((L\max+L\min)/2).$$

As shown in FIG. 23, in Examples 2 to 5 and Reference Example 2, the maximum value Lmax of the electrode distance was the length of an arc between the points Te and Te' (protruded frontward in the drawing, throughout Examples), and the minimum value Lmin of the electrode distance was the length of an arc between the points Tf and Tf'. The maximum value Lmin, the minimum value Lmin, and the parameter Pm in each of Examples 2 to 5 and Reference Example 2 are shown in the right of Table 2.

In each of the front covers of Examples 2 to 5 and Reference Example 2, a direct voltage was applied between the first electrode 26 and the second electrode 28. After the voltage was applied for 10 minutes, the cover surface temperature was measured by an infrared thermometer to evaluate the temperature distribution. The measurement was carried out at the room temperature of 20° C. The measured temperatures (the minimum temperature, the maximum temperature, and the difference thereof) are shown in the left of Table 2.

TABLE 2

| | Measured temperature (° C.) | | | Electrode distance (mm) | | |
|---|---|---|---|---|---|---|
| | Minimum | Maximum | Difference | Lmax | Lmin | Pm |
| Example 2 | 34 | 39 | 5 | 209 | 194 | 0.074 |
| Example 3 | 32 | 38 | 6 | 209 | 182 | 0.139 |
| Example 4 | 31 | 39 | 8 | 209 | 174 | 0.182 |
| Example 5 | 26 | 38 | 12 | 209 | 155 | 0.298 |
| Reference Example 2 | 24 | 40 | 16 | 209 | 130 | 0.471 |

Each front cover of Examples 2 to 4 exhibited a difference of approximately 5° C. to 8° C. between the minimum and maximum temperatures, and the front cover of Example 5 exhibited a difference of approximately 12° C. Thus, the front covers of Examples 2 to 5 exhibited uniform heat generation on the entire surfaces, thereby being advantageous in energy saving. In contrast, the front cover of Reference Example 2 exhibited a difference of 16° C., and the heat generation was not uniformly caused on the entire heat generator.

As is clear from the above results, the heat generators of Examples 2 to 5 satisfying the inequality of Pm≤0.375 exhibited uniform heat generation on the entire surfaces, unlike the heat generator of Reference Example 2 not satisfying the inequality.

It is to be understood that the heat generator of the present invention is not limited to the above embodiments, and various changes and modifications may be made therein without departing from the scope of the present invention.

The invention claimed is:

1. A heat generator, comprising:

a transparent film having a three-dimensional curved surface;

a first electrode and a second electrode facing each other on the three-dimensional curved surface of the transparent film; and a mesh conductive film on the three-dimensional curved surface of the transparent film between the first electrode and the second electrode, wherein the mesh conductive film includes conductive thin metal wires in a mesh pattern with a plurality of lattice intersections, and the thin metal wires have a width of 1 to 40 μm and the mesh pattern has a pitch of 0.1 to 50 mm, wherein Lmin is a minimum value of a distance between the first electrode and the second electrode, and Lmax is a maximum value of the distance between the first electrode and the second electrode, wherein (Lmax−Lmin)/((Lmax+Lmin)/2)≤0.375, and wherein Lmax and Lmin are distances between respective pairs of opposite points in the first electrode and the second electrode measured along the three-dimensional curved surface of the conductive film wherein the heat generator has a surface resistance of 10 to 500 ohm/sq and an electrical resistance of 12 to 120 ohm.

2. The heat generator according to claim 1, wherein the thin metal wires in the mesh pattern contain a metallic silver portion formed by exposing and developing a silver salt-containing layer containing a silver halide.

3. The heat generator according to claim 1, wherein the thin metal wires in the mesh pattern contain a patterned, plated metal layer.

4. The heat generator according to claim 1, wherein (Lmax−Lmin)/((Lmax+Lmin)/2)=0.074 to 0.298.

5. The heating generator according to claim 1, wherein the transparent film is a flexible plastic film.

6. The heating generator according to claim 5, wherein the flexible plastic film is composed of a material made from one or more of polyethylene terephthalates (PET), polyethylene naphthalates (PEN), polyvinyl chlorides, polyvinylidene chlorides, polyvinyl butyrals, polyamides, polyethers, polysulfones, polyether sulfones, polycarbonates, polyarylates, polyetherimides, polyetherketones, polyether ether ketones, polyolefins such as EVA, polycarbonates, triacetyl celluloses (TAC), acrylic resins, polyimides, and aramids.

7. The heat generator according to claim 1, wherein the mesh pattern, in plan view, has a rectangular shape with long sides extending from the first electrode to the second electrode.

* * * * *